US005695331A

United States Patent [19]

Nutter et al.

[11] Patent Number: 5,695,331

[45] Date of Patent: Dec. 9, 1997

[54] MULTIPLE WIDTH BOAT CARRIER FOR VERTICAL OVENS

[75] Inventors: Francis C. Nutter, Methuen; David S. Harvey, Littleton; Gerald E. Waldron, Foxboro, all of Mass.

[73] Assignee: BTU International, North Billerica, Mass.

[21] Appl. No.: 588,606

[22] Filed: Jan. 18, 1996

[51] Int. Cl.[6] ..... F27D 5/00

[52] U.S. Cl. ..... 432/253; 432/258; 432/259; 269/203

[58] Field of Search ..... 432/5, 6, 123, 432/126, 153, 234, 241, 253, 258, 259; 269/203, 903; 248/346.07, 346.06, 231.81

[56] References Cited

U.S. PATENT DOCUMENTS

| | | | |
|---|---|---|---|
| 807,613 | 12/1905 | Graves | 248/346.07 |
| 2,430,366 | 11/1947 | Porterfield | 269/203 |
| 3,094,258 | 6/1963 | Punke | 248/346.07 |
| 4,749,159 | 6/1988 | Hoff | 248/231.81 |
| 4,949,946 | 8/1990 | Buchter | 269/203 |
| 5,207,578 | 5/1993 | Sakata | 432/241 |
| 5,211,324 | 5/1993 | Fiedler | 228/44 |
| 5,273,244 | 12/1993 | Ono | 248/176 |
| 5,323,450 | 6/1994 | Goldhagen et al. | 379/100 |
| 5,383,783 | 1/1995 | Ishimori | 432/253 |
| 5,392,932 | 2/1995 | Vongfuangfoo | 211/26 |
| 5,438,740 | 8/1995 | Carr et al. | 269/903 |

FOREIGN PATENT DOCUMENTS

| | | | |
|---|---|---|---|
| 2134433 | 1/1983 | United Kingdom | 269/203 |

*Primary Examiner*—Henry A. Bennett
*Assistant Examiner*—Jiping Lu
*Attorney, Agent, or Firm*—Weingarten, Schurgin, Gagnebin & Hayes LLP

[57] ABSTRACT

A boat carrier for accommodating multiple width integrated circuit (IC) boats is provided. The boat carrier comprises a base member and opposed guide faces which abut side surfaces of IC boats of multiple widths. In a first embodiment, the boat carrier includes a first guide having a first guide face affixed to the base member, and a movable guide having a movable guide face releasably affixed to the base member. The movable guide face has a first position and a second position, whereby a narrower IC boat is receivable in the first position and a wider IC boat is receivable in the second position. In a further embodiment, the boat carrier comprises a base member, a fixed guide assembly having a fixed guide face, and an opposed guide assembly having an inner and outer guide face, whereby a boat having a first or second width is receivable. In yet another embodiment, the boat carrier comprises a further fixed guide assembly and a further opposed guide assembly, thereby forming dual sets of guides, wherein each set of guides is capable of receiving a boat having a first or second width.

6 Claims, 4 Drawing Sheets

MULTIPLE WIDTH BOAT CARRIER FOR VERTICAL OVENS

FIELD OF THE INVENTION

This invention relates to integrated circuit fabrication, and more particularly to an integrated circuit boat carrier for transporting integrated circuits through an oven during processing.

BACKGROUND OF THE INVENTION

Boats for retaining integrated circuits (ICs) and associated boat carriers are widely used in the IC manufacturing industry to provide a support means for ICs during various stages of IC fabrication, particularly stages involving heat processing. For example, in a typical IC assembly a chip die is inserted within a package cavity, the die connected to the package lead fingers, and the package cavity capped. To cap the IC, a ring of solder may be placed around the periphery of the lid where contact is made with the package. The assembled package is then subjected to a heating process wherein the lid and solder seal the package. Typically, the heating process includes passage through an oven under certain parameters such as temperature and humidity. A conveyor belt assembly is commonly used to transport the ICs through the oven.

A vertical oven is commonly used in preference over a horizontal oven since less work area is used for the oven and more space may be adapted to other IC fabrication processes. A vertical oven used in IC fabrication generally has a conveyor belt assembly wherein an operator on-loads ICs to boats which are placed upon boat carriers that are secured to the conveyor belt. The belt carries the boats and accompanying ICs through the oven until the processing step is complete.

A typical IC package is a Pin Grid Array (PGA) package illustrated in FIG. 1. A PGA is a square, usually ceramic package having a plurality of pins extending from the bottom of the package adapted for insertion to a socket attached to a Printed Wiring Board (PWB) or directly into the PWB itself. A conventional PGA boat is typically an elongated structure adapted to support a plurality of PGA ICs as they are transported through processing stages. The boat is a rigid platform provided with leg portions for retaining the ICs a fixed distance from the surface on which the boat rests. A PGA IC is placed upon the boat by aligning the pins with holes in the boat corresponding to the PGA pins.

Other boats for other IC packages may be used. For example, a boat may have an entire area cut out from the platform that would otherwise contact IC pins. This boat has stops protruding upward from the boat platform proximate the corners of the IC to retain the IC in place during transport. A boat may be adapted for any IC package such as Dual In-Line Package (DIP), Package Leaded Chip Carrier (PLCC), Ball Grid Array (BGA), or Quad Flat Pack (QFP) to name several representative packages.

Exemplary prior art Auer boats for microprocessor ICs are shown in FIGS. 2 and 3. A 3.1 inch Auer boat is shown generally at 1, and includes a boat leg portion 2, a further boat leg portion 3, and a boat platform 4 for supporting an integrated circuit. A 4.3 inch Auer boat is shown at 5 which includes a boat leg portion 6, a further leg portion 7 and a platform 8. The platforms 4 and 8 provide surfaces on which one or more ICs may be placed for transport. Generally, the center portion of the platform 4 and 8 is cut away where the majority of PGA IC pins extend from the IC package. This reduces damage to the IC pins. As shown in FIGS. 2 and 3, the Auer boats may accommodate four microprocessor ICs.

Boat carriers are adapted to support particular boats. The boat carrier retains the IC-loaded boat as a conveyor belt moves the assembly through the oven. A boat carrier includes a plate secured to the conveyor belt, and a plurality of support members on which the boat rests. When ICs of a different package are to be processed, an operator must place the boats on the boat carrier designed for that particular boat.

SUMMARY OF THE INVENTION

The present invention provides a boat carrier that accommodates multiple sized boats that are to be on-loaded and off-loaded in an IC fabrication environment. The boat carrier comprises a base member and opposed guide faces which abut side surfaces of IC boats of multiple widths. In a first embodiment, the multiple width boat carrier of the present invention includes a base member, a first guide having a first guide face affixed to the base member, and a movable guide releasably affixed to the base member, having an opposed movable guide face. The movable guide face is movable from a first position to a second position enabling the boat carrier to accommodate boats having multiple widths.

In another embodiment of the present invention, a boat carrier is adapted for multiple width boats and includes a fixed guide assembly having a fixed guide face, and an opposed guide assembly having an inner guide face and an outer guide face, each face extending from the base member. An integrated circuit boat having a first width is receivable within the fixed guide face and the inner guide face and an integrated circuit boat having a second width larger than the first width, is receivable within the fixed guide face and the outer guide face.

In yet another embodiment of the present invention, a multiple width boat carrier is provided having a further fixed guide assembly and a further opposed guide assembly thereby forming dual sets of guides, each set capable of receiving an integrated circuit boat having a first or second width.

DESCRIPTION OF THE DRAWINGS

The invention will be more fully understood from the following detailed description taken in conjunction with the accompanying drawings in which.

DETAILED DESCRIPTION OF THE INVENTION

Figure 1:
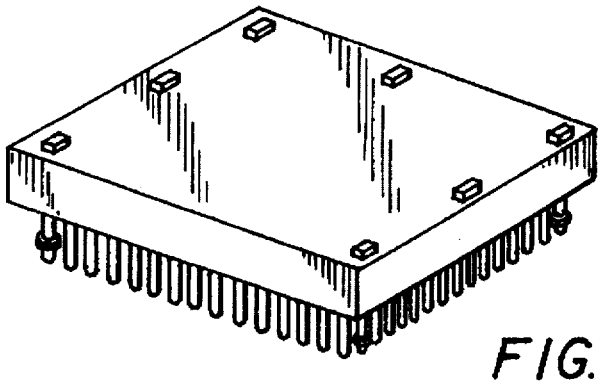
FIG. 1 PRIOR ART
FIG. 1 is a perspective view of a typical prior art PGA package IC.
Figure 2:
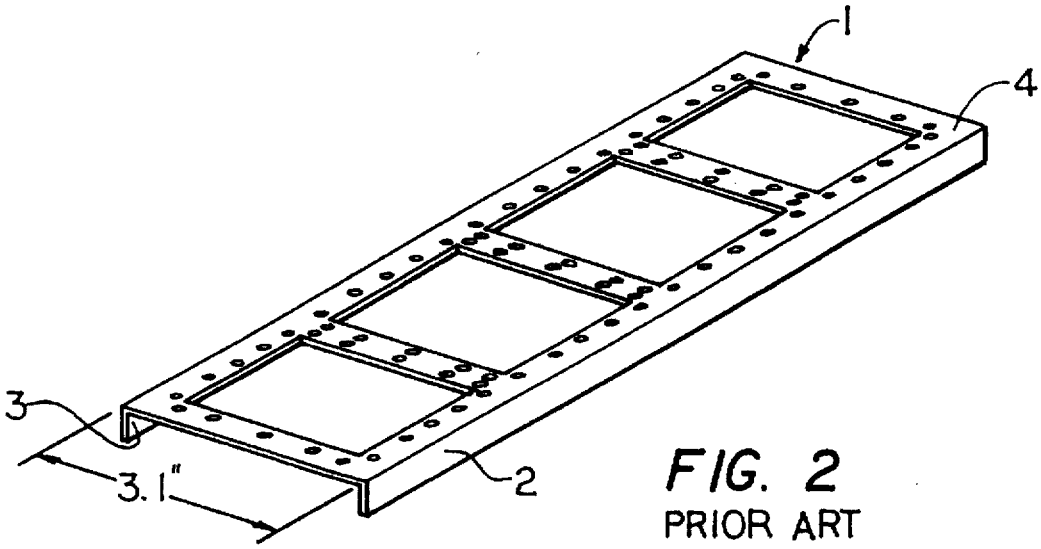
FIG. 2 PRIOR ART
FIG. 2 is a perspective view of a 3.1 inch prior art Auer boat carrier.
Figure 3:
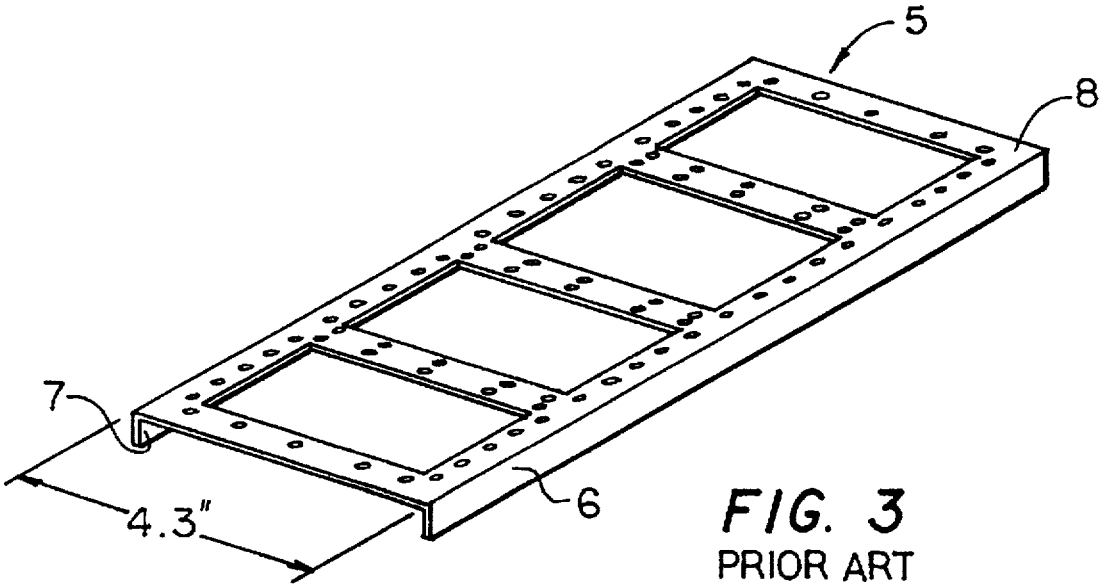
FIG. 3 PRIOR ART
FIG. 3 is a perspective view of a prior art 4.3 inch Auer boat carrier.
Figure 4:
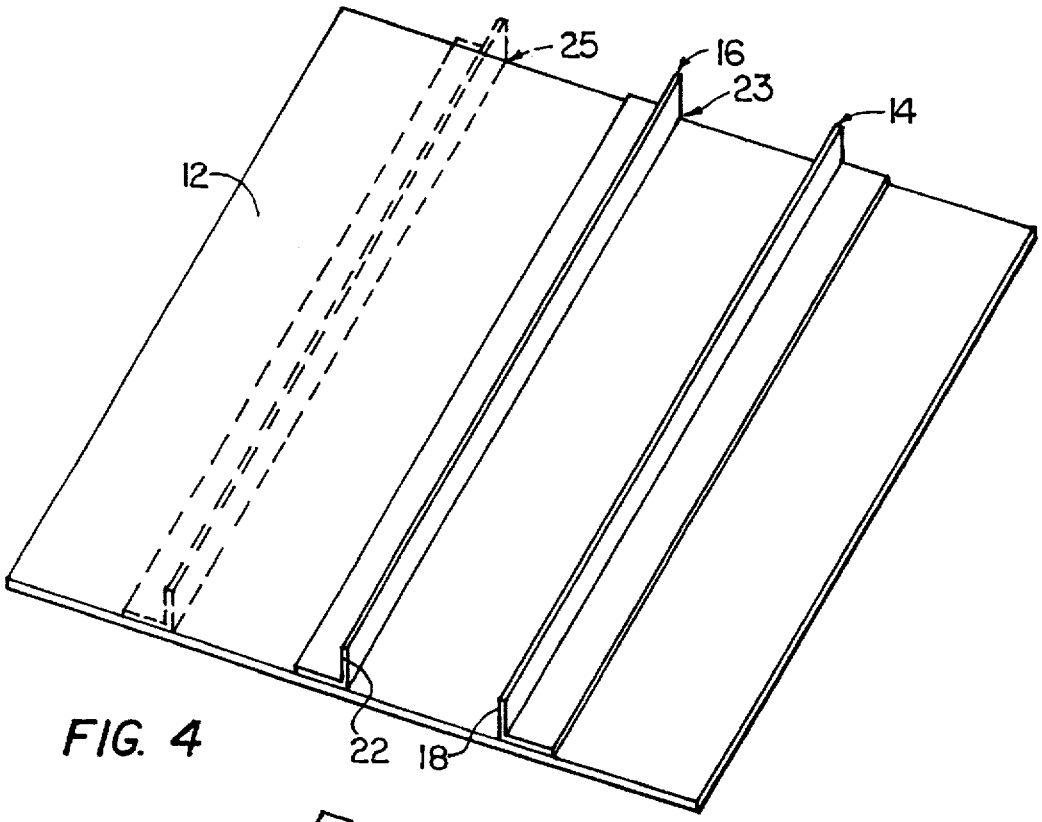
FIG. 4 is a perspective view of a multiple width boat carrier according to the present invention.

The integrated circuit boat carrier of the present invention, as shown in FIG. 4, is capable of accommodating different widths of integrated circuit boats. Exemplary Auer boats for microprocessors are illustrated in FIGS. 2 and 3. In a preferred embodiment illustrated in FIG. 4, the boat carrier includes a base or support surface 12 which provides a berth on which an IC boat may rest. The carrier also includes a first guide 14 and an opposed movable guide 16. The movable guide 16 is movable with respect to the support surface 12. Referring to FIGS. 2–4 in conjunction, the first guide 14, having a first guide face 18, abuts a boat leg portion 2 and the movable guide 16, having a further movable guide face 22, abuts a further leg portion 3 whereby the boat 1 is retained in place on the support surface 12. The movable guide face 22 is movable from a first position 23 to a second position 25 indicated by dashed lines, allowing the retention of boats having various widths. It will be appreciated by one skilled in the art, that the first guide 14 may be made to be movable among positions as well as the movable guide 16.

Figure 5:
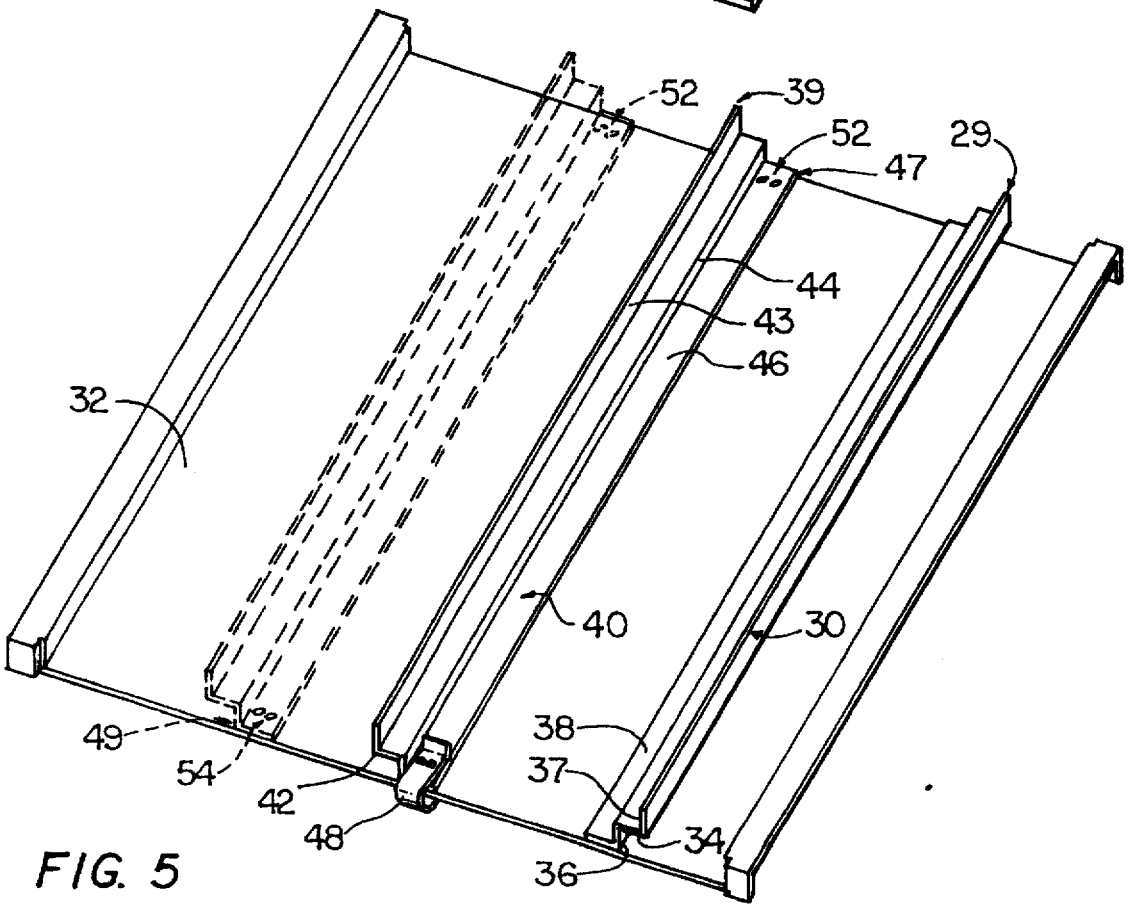
FIG. 5 is a perspective view of an alternative embodiment of the present invention.

FIG. 5 illustrates a further embodiment of a boat carrier adapted to accommodate boats of multiple widths. A first guide 29 is formed by a first elongated rail 30 immovably affixed to a plate 32. The first rail 30 includes a first support face 34 which forms a portion of the support surface 12 of FIG. 4, a first vertical face 36, a first guide face 37, and a first bottom member 38. The first rail 30 is secured to the plate 32 at the first bottom member 38 in a conventional manner, such as by welding. The first bottom member 38 comprises an elongated rectangle adjoined to the first vertical face 36, also an elongated rectangle, in a substantially perpendicular manner. The first vertical face 36 adjoins the first support face 34 in a perpendicular fashion and the first support face is perpendicularly adjoined to the first guide face 37 in a configuration wherein, the first bottom member 38, the first vertical and support faces 36 and 34 respectively, and the first guide face 37 form a laterally elongated step.

A movable guide 39 is formed by a movable elongated rail 40 which includes a movable support face 42 which forms a further portion of a support surface 12 of FIG. 4, a movable vertical face 44, a movable guide face 43, and a movable bottom member 46. The movable support and vertical faces 42 and 44, the movable bottom member 46 and the movable guide face 43, similarly form an elongated step as in the first rail 30, wherein the movable bottom member 46 is perpendicular to the movable vertical face 44, the movable vertical face is perpendicular to the movable support face 42, and the movable support face is perpendicular to the movable guide face 43. The first support face 34 and the movable support face 42 cooperatively form the support surface 12 of FIG. 3.

The movable guide 39 includes a first set of holes 52 and a second set of holes 54 in the movable bottom member 46. Each set of holes 52 and 54, include two holes in the movable bottom member 46, each set at either end of the bottom member. The slider clips 48 affix the movable guide 39 to the plate 32 at the first and second set of holes 52 and 54, while allowing the movable guide to be slid from the first position 47 to the second position 49. Although not shown, it will be appreciated that clips 48 are present at both ends of the movable guide 39.

Figure 6:
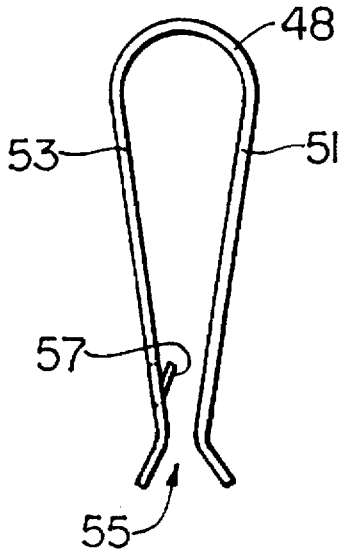
FIG. 6 is a side view of a clip.
Figure 7:
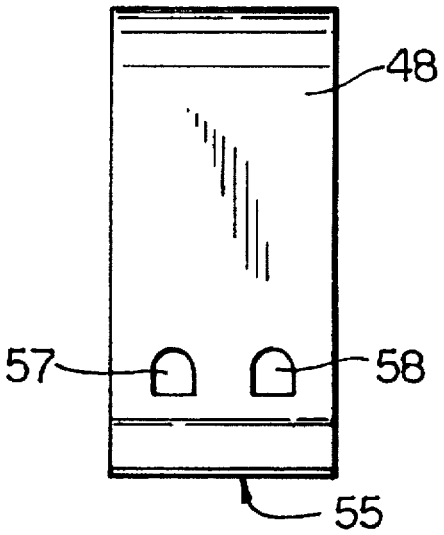
FIG. 7 is a top view of the clip of FIG. 6.
Figure 8:
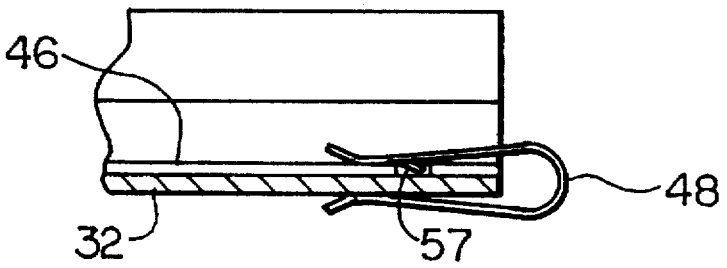
FIG. 8 is a partial cross-sectional view of the clip of FIG. 6 shown affixing the movable guide to the plate.

FIGS. 6–8 illustrate the clip 48 features. The clip 48 is formed of stainless steel sheet metal bent to form a continuous arcuate body and two arms 51 and 53, wherein the two arms of the clip approach each other to form a mouth 55. The ends of the two arms 51 and 53, are flared after the mouth 55 to ease entry of the flat plate 32 and bottom member 46 together into the mouth of the clip. The clip thereby acts as a clamp, with the arms 51 and 53, biased toward each other.

Within the body of the clip 48, two retaining prongs 57 and 58, are formed by bending portions of the clip away from the clip body. Referring now to FIG. 5 in conjunction with FIG. 6, it can be seen that the retaining prongs 57 and 58 correspond to the two holes of the first and second sets of holes 52 and 54 in the bottom member 46. Upon application of the clip 48 to the bottom member 46, the retaining prongs 57 and 58 enter the two holes and meet the plate 32, thus slidably affixing the movable guide 39 to the plate.

The first rail 30 and movable rail 40 are substantially parallel and arranged whereby the first guide face 37 and the movable guide face 43 are spaced a further distance than the first bottom member 38 and the movable bottom member 46, one rail being a mirror image of the other.

The first and movable rails, 30 and 40 respectively, the plate 32, and the slider clips 48, are fabricated from stainless steel sheet metal. It will be appreciated by one skilled in the art, that the movable rail 40 may be made movable between positions in a manner similar to the first rail 30.

The multiple width boat carrier of the present invention is utilized in an exemplary manner as a boat carrier for Auer boats. Auer boats for microprocessor ICs, shown in FIGS. 2 and 3, are typically 3.1 inches or 4.3 inches wide. The Auer boat leg portions 2 and 3 or 6 and 7 keep ICs a fixed distance from the plate 32 during transport. For a 3.1 inch wide Auer boat, leg portions 2 and 3 rest on the first support face 34 and movable support face 42, respectively. The first guide face 37 and the movable guide face 43 abut the Auer boat leg portions 2 and 3, ensuring that the boat remains on the carrier.

An operator may adjust the movable rail 40 from a first position 47 to a second position 49 depending on the size of the boat. As shown in FIG. 5, the movable rail 40 is adjustable from a first position 47 to a second position 49 to accommodate boat carriers of varying widths. While the movable rail 40 is in the first position, a 3.1 inch Auer boat 1 may be placed upon the boat carrier. Boat leg portions 2 and 3 rest on the first and movable support faces 34 and 42, respectively. When the movable rail 40 is moved to the second position, the first and second support rails correspond to the leg portions 6 and 7 of a 4.3 inch Auer boat 5. In each case the corresponding first guide 29 and the movable guide 39, abut the boat leg portions 6 and 7, respectively, thereby preventing the boat 5 from moving off the boat carrier. Further, substantial movement of the boat during transport is prevented by the leg portions 2 and 3 or 6 and 7 abutting the first guide face 37 and the movable guide face 43.

When the operator desires to place a 4.3 inch boat onto the multiple width boat carrier of the present invention, the operator moves, if necessary, the movable rail 40 from the first position to the second position. For a 3.1 inch boat, the operator moves the movable rail 40, if necessary, from the second position to the first position. In this manner, an operator may on-load and off-load boats from the boat carrier having multiple widths without making adjustments within the oven. The loaded boat carrier is then transported on a conveyor belt (not shown) and the ICs properly processed in the oven (not shown).

Figure 9:
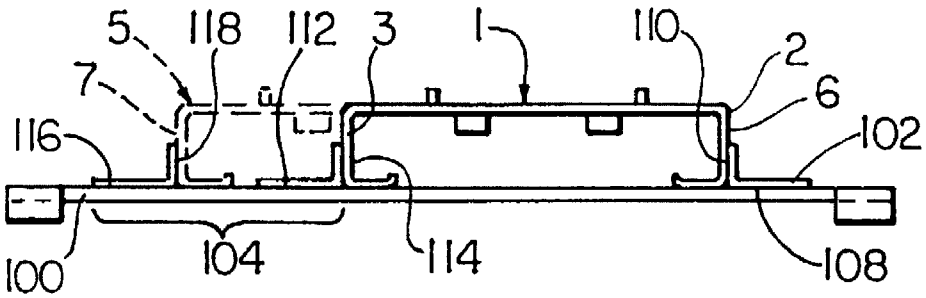
FIG. 9 is a front view of an alternative embodiment of the present invention.

In another embodiment, as shown in FIG. 9, the multiple width boat carrier comprises three fixed guides sized to allow placement of the whole boat thereover, without interference, while still permitting retention of the narrower boat there-between. Specifically, the boat carrier comprises a base member or plate 100, a fixed guide assembly 102 having a fixed guide face 110, and an opposed guide assembly 104 having an inner guide face 114 and an outer guide face 118.

The fixed guide assembly 102 further includes a fixed bottom member 108 secured to the plate 100. The fixed guide face 110 is orthogonally joined to the fixed bottom member 108, forming an 'L' shape. The opposed guide assembly 104 further includes an inner bottom member 112 affixed to the plate 100 wherein the inner guide face 114 is orthogonally joined to the inner bottom member. The opposed guide assembly 104 also includes an outer bottom member 116 affixed to the plate 100, wherein the outer guide face 118 is perpendicularly adjoined to the outer bottom member. The fixed, inner and outer guide faces 110, 114, and 118 respectively, are substantially parallel wherein the fixed guide face 110 and the inner guide face 114 oppose each other, one a mirror image of the other. Similarly, the fixed guide face 110 also opposes the outer guide face 118.

An operator places the 3.1 inch boat leg portions 2 and 3 within the fixed guide face 110 and the inner guide face 114. A 4.3 inch boat and associated leg portions 6 and 7 respectively, is placed within the fixed guide face 110 and the outer guide face 118. The boat leg portions 6 and 7 rest on the plate 100, abutted on one side by the fixed guide face 110 and on the other side by the outer guide face 118. For a 3.1 inch wide boat 1 the leg portion 2 abuts the fixed guide face 110 and the leg portion 3 abuts the inner guide face 114.

The inner guide face 114 does not interfere with either the 4.3 inch boat 5 or an IC carried by the boat. There is adequate clearance from the top of the inner guide face 114 to the boat 5 and from the inner guide face to any ICs carried by the boat. One skilled in the art can appreciate the damage that is possible if proper clearance is not attained.

Figure 10:
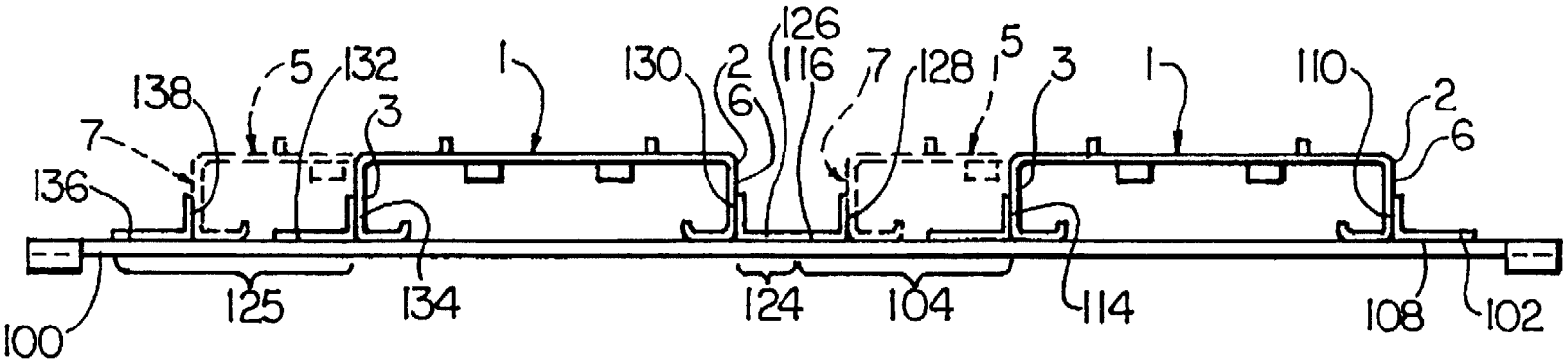
FIG. 10 is a front view of a further embodiment of a multiple width boat carrier of the present invention.

FIG. 10 shows a further embodiment of the invention shown in FIG. 9, which can accommodate two boats side by side, and further includes a further fixed guide assembly 124 and a further opposed guide assembly 125. The further fixed guide assembly 124 includes a further fixed bottom member 126, and a further fixed guide face 130 wherein the further fixed bottom member and the outer bottom member 116 are adjoined thereby forming a 'U' shape. The further fixed bottom member 126 is perpendicular to the further fixed guide face 130.

The further opposed guide assembly 125 includes a further inner bottom member 132 secured to the plate 100 and a further inner guide face 134 orthogonal to the further inner bottom member. The further inner guide face 134 is a mirror image of the further fixed guide face 130. The further opposed guide assembly 125 also includes a further outer guide face 138 arranged in parallel to the further inner guide face 134, and a further outer bottom member 136 secured to the plate 100. The further outer guide face 138 is orthogonal to the further outer bottom member. The further outer guide face 138 is also a mirror image of the further fixed guide face 130.

Having a further fixed guide assembly 124 and a further opposed guide assembly 125 available, the operator has the ability to on-load either 3.1 or 4.3 inch boats within the parallel sets of boat guides with no manual adjustment by the operator. The 3.1 inch boat leg portions 2 and 3, if placed within the first set of boat guides abut the fixed guide face 110 and the inner guide face 114, and if placed within the second set of guide rails the leg portions abut the further fixed guide face 130 and the further inner guide face 134. The 4.3 inch leg portions 6 and 7 abut the fixed guide face 110 and the outer guide face 128 if within the first set of guide rails and if placed within the second set of guide rails abut the further fixed guide face 130 and the further outer guide face 138. Thus each set of guides accepts both 3.1 and 4.3 inch wide boats.

Alternatives and modifications to the aforedescribed embodiment are possible. For example, the rails may not be continuous, but formed of discrete segments that may form a suitable support surface. Further, the rail components may be configured in ways other than perpendicular angles. Also, many different ways of attaching a support surface to a plate are possible. Still further, the opposed guide assembly may have a single bottom member from which the inner and outer guides may extend. Many other configurations are possible without departing from the scope and spirit of the above embodiment.

The invention is not to be limited by what has been particularly shown and described, except as indicated by the appended claims. The present invention contemplates use beyond the confines of the integrated circuit fabrication industry. For example, in a manufacturing environment utilizing conveyor belts, the present invention may be adapted to provide a means for allowing multiple sized items to be transported on the belt.

What is claimed is:

1. A boat carrier to accommodate multiple sized integrated circuit boats for transport through an oven for processing comprising:

a base member;

a multi-position boat receiving assembly for receiving circuit boats of differing widths comprising opposed guide faces supported by said base member and disposed and spaced to abut side surfaces of a first circuit boat and to abut side surfaces of a further circuit boat wider than the first circuit boat, said multi-position boat further comprising a first elongated rail and a movable elongated rail;

wherein said first elongated rail comprises:

a first bottom member affixed to said base member, a first vertical face extending from and generally perpendicular to said first bottom member, a first support face extending from and generally perpendicular to said first vertical face, and a first guide face extending from and generally perpendicular to said support face, said first guide face forming one of said opposed guide faces; and wherein said movable elongated rail comprises:

a movable bottom member affixed to said base member, a movable vertical face extending from and generally perpendicular to said movable bottom member, a movable support face extending from and generally perpendicular to said movable vertical face, said movable support face and said first support face cooperative to provide a support surface for an integrated circuit boat, and a movable guide face extending from and generally perpendicular to said movable support face, said movable guide face forming another of said opposed guide faces.

2. The boat carrier of claim 1, further comprising a clip for releasably fixing said movable elongated rail to said base member.

3. The boat carrier of claim 1, wherein said movable bottom member further includes a first and second set of holes, each set having a first and second hole, said first set of holes corresponding to a first position of said at least two positions, and said second set of holes corresponding to a second position of said at least two positions, wherein a first clip is disposed within one hole of said first or second set of wholes and a second clip is disposed within the other hole of said first or second set of holes.

4. The boat carrier according to claim 1, wherein said boat carrier is formed from stainless steel.

5. The boat carrier according to claim 1, wherein said integrated circuit boat comprises an Auer boat.

6. The boat carrier according to claim 1, wherein said multiple sized integrated circuit boats comprise 3.1 inch and 4.3 inch Auer boats.

* * * * *